137-13 SR
3/8/77 XR 4,010,622

United States Patent [19]

Etter

[11] 4,010,622

[45] Mar. 8, 1977

[54] METHOD OF TRANSPORTING NATURAL GAS

[76] Inventor: Berwyn E. Etter, 368 Boca Ciega Point Blvd. South, Madeira Beach, Fla. 33708

[22] Filed: June 18, 1975

[21] Appl. No.: 587,830

[52] U.S. Cl. ..... 62/48; 62/55; 137/13; 252/73

[51] Int. Cl.[2] ..... F17C 7/02

[58] Field of Search ..... 62/17, 20, 48, 55; 252/71, 73, 372; 431/344; 137/1, 13

[56] References Cited

UNITED STATES PATENTS

| | | | |
|---|---|---|---|
| 3,055,427 | 9/1962 | Pryor et al. | 431/344 |
| 3,331,214 | 7/1967 | Proctor et al. | 62/20 |

*Primary Examiner*—Ronald C. Capossela
*Attorney, Agent, or Firm*—Zarley, McKee, Thomte, & Voorhees

[57] ABSTRACT

A means for transporting natural gas which eliminates the need for ultra low temperature refrigeration units. The method comprises saturating natural gas at its source with certain hydrocarbon additives which liquefy at substantially higher temperatures than natural gas alone, liquefying the saturated mixture for fuel transport, transporting the mixture to its destination for usage, and adding sufficient air to the mixture prior to combustion to provide a fuel of a normal Btu capacity.

8 Claims, No Drawings

METHOD OF TRANSPORTING NATURAL GAS

BACKGROUND OF THE INVENTION

Natural gas, as is well known, is a mixture of low molecular weight, paraffin hydrocarbons which typically comprises at least 85% methane, and more typically 90% or more of methane. It is a colorless almost odorless gas which is used as a common industrial fuel, as a cooking gas, as a heating gas, and the like. Primary source of natural gas is from natural degradation of organic materials by heat and pressure in the earth. Large caverns of natural gas exist within the earth and typically exist immediately above oil pools.

The natural gas must be transported from its source in the earth to its ultimate end use point. Quite naturally, since natural gas is a gas its volume is quite large and its transportation very difficult in its gaseous state. As a result, transportation of natural gas from its source to its point of usage has been a difficult problem. The problem has been approached in many different manners. One of the more common is to place the natural gas under extreme pressure to liquefy the natural gas and ship it in tanks. However, of course, the use of additional energy and additional expense is necessitated by the pressurization process.

Another means of attacking the problem has typically been to liquefy the natural gas at extremely low temperatures and to transport the liquefied natural gas in refrigerated units at such low temperatures. For example, natural gas, at ambient pressure, will liquefy at minus 270° F. In this manner of shipping of natural gas from its source, extremely large refrigeration units, for example, refrigeration ships, have been built at extreme cost to transport the liquefied natural gas from its source to its point of designated usage. In spite of the extreme cost of such ships, this method of transportation is much more efficient than transporting the gas in its gaseous state since substantially greater quantities can be transported per given unit of volume.

Still, as one can well imagine, it is extremely expensive to provide the energy for such large transportable refrigeration units. Therefore, a significant savings of energy and correspondingly a significant savings of cost of natural gas, could be provided if the need for excessively large transportable refrigeration units could be eliminated.

Accordingly, one object of this invention is to provide a method of transporting natural gas which does not require ultra low temperature refrigeration units.

Another object of this invention is to provide a method of transporting natural gas which eliminates the need for refrigeration units which can refrigerate natural gas to temperatures as low as minus 270° F.

Yet another object of this invention is to provide a method of transporting natural gas which utilizes substantially lesser quantities of energy for refrigeration of the natural gas during transport.

A still further object of this invention is to provide a method of transporting natural gas which allows liquefication of natural gas, at atmospheric pressure, at temperatures as high as minus 50° F.

Another object of this invention is to provide not only a method of transporting natural gas at substantially higher temperatures than utilized in the past, but also of increasing the Btu capacity of the transported natural gas.

The method of accomplishing these and other objects of the invention will become apparent from the following detailed description of the invention.

DETAILED DESCRIPTION OF THE INVENTION

In accord with the process of this invention the temperature at which natural gas will liquefy and thereafter be in a physical form for more efficient transportation, is substantially increased. Natural gas as it is pumped from its sources in the earth typically will liquefy, assuming atmospheric pressure, in the neighborhood of minus 270° F. As heretofore explained, such low temperature liquefication necessitates extremely expensive refrigeration equipment and, of course, substantial increased costs for the natural gas itself.

It has now been found that the temperature at which natural gas will liquefy can be substantially raised to temperatures as high as minus 50° F by adding to the fuel gas as it is removed from its earth source a hydrocarbon fuel gas additive which liquefies at substantially higher temperatures than the natural gas alone. Preferably, the amount of the organic fuel gas additive is a saturating amount at the normal conditions of temperature of pressure at which the natural gas is removed from its source.

In typical mining operations, the well is capped and the natural gas is pumped out. In accord with the process of this invention during the removal of the natural gas from its cavern within the earth, hydrocarbon additives of this invention are injected by a conventional means into the stream of natural gas to provide a mixture. The additives utilized herein liquefy at substantially higher temperatures than the natural gas alone with the result being that the mixture of the two, i.e., the natural gas plus the additive, will liquefy at a temperature substantially higher than the temperature at which natural gas alone will liquefy.

The amount of the fuel gas additive is preferably an amount which will saturate the natural gas at its ambient conditions of temperature and pressure. However, amounts even as small as 0.1% by volume of the natural gas will have some affect in raising the liquefication temperature for the mixture. Thus, in its broadest aspect the amount of additive to the natural gas can be from 0.1% by volume up to a saturating amount at the conditions of temperature and pressure of the natural gas as it is removed from its source. As a general guideline, satisfactory results are obtained when the amount of additive composition is from about 1 pound of additive per hundred cubic feet of fuel gas to about 1 pound of additive per 300 cubic feet of fuel gas with 1 pound of additive per 200 cubic feet of fuel gas being preferred. When amounts of additive utilized within this range are employed, and amounts within the range of 1 pound per hundred cubic feet of natural gas to 1 pound per 300 cubic feet of natural gas, the temperature at which the natural gas will liquefy can be raised significantly to temperatures as low as minus 50° F.

The organic additives alcohols, may be utilized for mixing with the natural gas in order to substantially increase the temperature at which the natural gas will liquefy, can be described as normally liquid at ambient conditions, compounds which when combusted yield only carbon and hydrogen containing byproducts and are selected from the group consisting of hydrocarbons, alchols, esters, or mixtures thereof.

The preferred hydrocarbons are $C_5$ to $C_{20}$ straight and branched chain alkanes and cycloalkanes, straight and branched chain alkenes and cycloalkenes, straight and branched chain alkynes and cycloalkynes; aromatic compounds selected from the group consisting of mononuclear aromatics, i.e. benzenes, and including as polynuclear aromatics naphthalenes, anthrazenes and phenanthrenes. Additionally, $C_7$ to $C_{20}$ straight and branched chain arenes, namely straight and branched chain benzenes.

Examples of suitable $C_5$ to $C_{20}$ alkanes include n-Pentane, 2-Methylbutane, 2,2-Dimethylpropane, n-Hexane, 2-Methylpentane, 3-Methylpentane, 2,2-Dimethylbutane; 2,3-Dimethylbutane, n-Heptane, 2, Methylhexane, 3-Methylhexane, 3-Methylhexane, 3-Ethylpentane, 2,2-Dimethylpentane, 2,3-Dimethylpentane, 2,4-Dimethylpentane, 3,3-Dimethylpentane, 2,2,3-Trimethylbutane, n-Octane, 2-Methylheptane, 3-Methylheptane, 4-Methylheptane, 3-Ethylhexane, 2,2-Dimethylhexane, 2,3-Dimethylhexane, 2,4-Dimethylhexane, 2,5-Dimethylhexane, 3,3-Dimethylhexane, 3,4-Dimethylhexane, 2-Methyl-3-ethylpentane, 3-Methyl-3-ethylpentane, 2,2,3-Trimethylpentane, 2,2,4-Trimethylpentane, 2,3,3-Trimethylpentane, 2,3,4-Trimethylpentane, 2,2,3,3-Tetramethylbutane, n-Nonane, 2-Methyloctane, 3-Methyloctane, 4-Methyloctane, 3-Ethylheptane, 2,2-Dimethylheptane, 2,6-Dimethylheptane, 2,2,4-Trimethylhexane, 2,2,5-Trimethylhexane, 2,3,3-Trimethylhexane, 2,3,5-Trimethylhexane, 2,4,4-Trimethylhexane, 3,3,4-Trimethylhexane, 3,3-Diethylpentane, 2,2-Dimethyl-3-ethylpentane, 2,4-Dimethyl-3-ethylpentane, 2,4-Dimethyl-3-ethylpentane, 2,2,3,3-Tetramethylpentane, 2,2,3,4-Tetramethylpentane, 2,2,4,4-Tetramethylpentane, 2,3,3,4-Tetramethylpentane, n-Decane, 2-Methylnonane, 3-Methylnonane, 4-Methylnonane, 5-Methylnonane, 2,7-Dimethyloctane, 2,2,6-Trimethylheptane, n-Undecane, n-Dodecane, n-Tridecane, n-Tetradecane, n-Pentadecane, n-Hexadecane, n-Heptadecane, n-Octadecane, n-Nonadecane, n-Eicosane.

Examples of suitable $C_5$ to $C_{20}$ cycloalkanes include Cyclopentane, Methylcyclopentane, Ethylcyclopentane, 1,1-Dimethycyclopentane, 1,cis-2-Dimethylcyclopentane, 1,trans-2-Dimethylcyclopentane, 1,cis-3-Dimethylcyclopentane, 1,trans-3-Dimethylcyclopentane, n-Propylcyclopentane, Isopropylcyclopentane, 1-Methyl-1-ethylcyclopentane, 1-Methyl-cis-2-ethylcyclopentane, 1-Methyl-trans-2-ethylcyclopentane, 1-Methyl-cis-3-ethylcyclopentane, 1-Methyl-trans-3-ethylcyclopentane, 1,1,2-Trimethylcyclopentane, 1,1,3-Trimethylcyclopentane, 1,cis-2, cis-3-Trimethylcyclopentane, 1,cis-2, trans-3-Trimethylcyclopentane, 1,trans-2, cis-3-Trimethylcyclopentane, 1,cis-2,cis-4-Trimethylcyclopentane, 1,cis-2, trans-4-Trimethylcyclopentane, 1,trans-2,cis-4-Trimethylcycolopentane, n-Butylcyclopentane, Isobutylcyclopentane, sec-Butycyclopentane, tert-Butylcyclopentane, 1-Methyl-cis-2-n-propylcyclopentane, 1-Methyl-trans-2-n-propylcyclopentane, 1-Methyl-isopropylcyclopentane, 1,cis-2-Diethylcyclopentane, 1,trans-2-Diethylcyclopentane, Cyclohexane, Methylcyclohexane, Ethylcyclohexane, 1,1 Dimethylcyclohexane, 1,cis-1-Dimethylcyclohexane, 1,trans-2-Dimethylcyclohexane, 1,cis-3-Dimethylcyclohexane, 1,trans-3-Dimethylcyclohexane, 1, cis-4-Dimethyl-cyclohexane, 1,trans-4-Dimethylcyclohexane, n-Propylcyclohexane, Isopropylcyclohexane, 1,1,2-Trimethylcyclohexane, 1,1,3,Trimethylcyclohexane, 1,trans-2,trans-4-Trimethycyclohexane, n-Butylcyclohexane, Isobutylcyclohexane, sec-Butylcyclohexane, tert-Butylcyclohexane, 1-Methyl-4-isopropylcyclohexane, Cycloheptane, Ethylcycloheptane, Cyclooctane, Methylcyclooctane, Cyclononane.

Examples of some of the suitable and representative hydrocarbon compounds of the group of $C_5$ to $C_{20}$ alkenes include 1-Pentene, cis-2-Pentene, trans-2-Pentene, 2-Methyl-1-butene, 3-Methyl-1-butene, 2-Methyl-2-butene, 1-Hexene, cis-2-Hexene, trans-2-Hexene, cis-3-Hexene, trans-3-Hexene, 2-Methyl-1-pentene, 3-Methyl-1-pentene, 4-Methyl-1-pentene, 2-Methyl-2-pentene, 3-Methyl-trans-2-pentene, 3-Methyl-cis-2-Pentene, 4-Methyl-cis-2-pentene, 4-Methyl-trans-2-pentene, 3-Methyl-cis-2-Pentene, 4-Methyl-cis-2-pentene, 4-Methyl-trans-2-pentene, 2,3-Dimethyl-1-butene, 3,3-dimethyl-1-butene, 3,3-Dimethyl-2-butene, 1-Heptene, cis-2-Heptene, trans-2-Heptene, cis-3-Heptene, trans-3-Heptene, 4,4-Dimethyl-1-pentene, 2,3-Dimethyl-2-pentene, 2,3,3-Trimethyl-1-butene, 1-Octene, cis-2-Octene, trans-2-Octene, trans-3-Octene, cis-4-Octene, trans-4-Octene, 2-Methyl-1-heptene, 2,3-Dimethyl-2-hexene, 2,3,3-Trimethyl-1-pentene, 3,4,4-Trimethyl-1 -pentene, 2,4,4-Trimethyl-2-Petene, 1-Nonene, 2,3-Dimethyl-2-heptene.

Examples of suitable $C_5$ to $C_{20}$ cycloalkenes include Cyclopentene, Cyclohexene, 4-Methylcyclohexene-1, 4-Vinyl-cyclohexene -1, 1,5-Cyclooctadiene.

Examples of suitable aromatics include benzene, and with respect to polynuclear aromatics, anthrazene and phenanthrene, and with respect to arenes, toluene, Ethylbenzene, 1,2-Dimethylbenzene, 1,3-Dimethylbenzene, 1,4-Dimethylbenzene, n-Propylbenzene, Isopropylbenzene, 1-Methyl-2-ethylbenzene, 1-Methyl-3-ethylbenzene, 1-Methyl-4-ethylbenzene, 1,2,3-Trimethylbenzene, 1,2,4-Trimethylbenzene, 1,3,5-Trimethylbenzene, n-Butylbenzene, Isobutylbenzene, sec-Butylbenzene, tert-Butylbenzene, 1-Methyl-2-isopropylbenzene, 1-Methyl-3-isopropylbenzene, 1-Methyl-4-isopropylbenzene, Styrene, n-Methylstyrene, cis-Methylstyrene, trans-Methylstyrene, o-Methylstyrene, =-Methylstyrene, p-Methylstyrene, Phenylacetylene.

Of the hydrocarbon additives, the preferred additives are the $C_5$ through $C_8$ straight and branched chain alkanes and cycloalkanes and the $C_5$ to $C_8$ alkenes and cycloalkenes.

Suitable alcohols are the $C_5$ to $C_{20}$ mono, di, and polyalcohols of the hydrocarbons previously mentioned herein. The preferred alcohols are the mono, di, and polyalcohols of the $C_5$ through $C_8$ hydrocarbons previously mentioned herein and include pentanols, hexanols, heptanols, octanols, pentenols, hexenols, heptenols, and octenols.

Examples of suitable esters are the $C_5$ to $C_{20}$ containing esters of both aliphatic carboxyllic acids and aromatic carboxyllic acids providing that the ester is a liquid under ambient conditions. The preferred esters are the $C_5$ to $C_8$ containing esters of lower $C_1$ to $C_4$ alcohols and lower $C_1$ to $C_4$ aliphatic carboxyllic acids.

As briefly mentioned herein previously, it is important that the additives for the industrial fuels be liquid at ambient conditions for several reasons. The first, the liquid additives are the easiest to handle, secondly, these lower chain length liquid additives have a substantial vapor pressure at ambient conditions and can be readily vaporized for convenient mixture with natural gases, and third they are readily available.

A chain length of from about $C_5$ to about $C_{20}$ has been found to be the practical range of utilization in this invention. Where the chain length is lower than $C_5$ it has been found that the heat of vaporization of the hydrocarbon compound, or likewise with respect to the alcohol and ester compounds, is sufficiently low that no substantial improvement in liquid temperature is noted. On the other hand, where the chain length is above $C_{20}$ many of the compounds are not liquid, not readily available, and if available, and even if liquid, have such low vapor pressures that no substantial volatilization will occur resulting in a very low amount of the additive present in an industrial fuel gas.

It is also important to note that the additives of this invention are nonsubstituted compounds. That is to say, they are comprised of only hydrogen and carbon, and with respect to the alcohols and esters oxygen in addition. There can be no substitutions of, for example, sulphur, chlorine, other halogens and the like. This is extremely important because it has been found that substituted hydrocarbons, alcohols, and esters will provide undesirable polluting byproducts upon combustion. For example, compounds containing sulphur and nitrogen will provide oxides of sulphur and oxides of nitrogen which are known to be hazardous pollutants. Thus, it is important that all of the compounds be nonsubstituted.

All of the hydrocarbon additives previously described herein have in common the fact that they will liquefy at substantially higher temperatures than natural gas itself. As a result, mixtures of these organic hydrocarbon additives and natural gas, at constant conditions of temperature and pressure, will liquefy at substantially higher temperatures than will natural gas alone, i.e., at temperatures substantially above minus 270° F. As a result, the amount of energy needed during refrigeration in order to liquefy the mixture, is substantially less than for natural gas alone. Thus the next step in the process of this invention, after saturating the natural gas with the organic, e.g. hydrocarbon additive, is liquefying the mixture in readying it for fuel transport. Such liquefication procedures are well known and generally comprise refrigeration at either their ambient pressure or under increased pressure. However, since the manner of refrigeration in order to accomplish liquefication of the fuel does not form a part of this invention and is well known in the art, a detailed description need not be given herein.

Thereafter, the liquefied fuel composition is transported to its destination for usage. Transporting can be accomplished by refrigerated ships, refrigerated trucks, refrigerated railroad cars, or such like refrigeration units.

After reaching its ultimate end-use destination point, the fuel gas mixture is again allowed to vaporize at which point it is then mixed with sufficient amounts of air to provide a fuel having the desired energy capacity needed. Typically, natural gas is "cut" with sufficient air in order to provide a fuel which has a normal energy capacity of 1000 Btu per cubic foot. Thus, as can be seen, the overall process of this invention allows substantially reduced energy requirements for liquefication and transport of the natural gas from its source to its end-use point. As an additional advantage, the organic hydrocarbon fuel additives which are added in order to decrease the required energy needs for liquefication of the natural gas also provide for an increased energy capacity of the fuel when that fuel mixture is compared with natural gas alone. Thus the additives of this invention have an additional advantage in that they provide for increased fuel efficiency and work capacity because of the increased energy released by the heat of combustion of the fuel additives. Thus, when industrial fuel gases such as natural gas are saturated with the additives of this invention, mixed with oxygen and burned, much more heat is available to be liberated by the flame and a much hotter flame often results. In addition, since the additives are nontoxic and when combusted produce no polluting byproducts, the fuel is safe for handling purposes, the amount of energy expended in transport of the fuel is significantly reduced, and the work capacity of the fuel is significantly increased. Thus as can be seen the invention accomplishes at least all of its stated objects.

What is claimed is:

1. A method of transporting natural gas which eliminates the need for ultra low temperature refrigeration units, said method comprising, saturating natural gas at its source with an organic additive which is normally liquid at ambient conditions and is selected from the group consisting of $C_5$ to $C_{20}$ hydrocarbons, alcohols and esters, and mixtures thereof, which when combusted yield only carbon and hydrogen containing products, to provide a mixture which liquefies at substantially higher temperatures than natural gas alone, liquefying all of said mixture for fuel transport, transporting said liquefied mixture to its destination for end useage, vaporizing said mixture, and adding sufficient air to said mixture prior to combustion to provide a fuel of normal Btu capacity.

2. The process of claim 1 wherein the organic fuel additive is one which yields as major combustion components nearly all carbon dioxide and water and is substantially free of combustion byproducts of sulphur and nitrogen, the amount of additive being from 0.1% by volume of said gas up to and including a vapor saturation amount at the existing conditions of temperature and pressure of said fuel gas.

3. The method of claim 2 wherein said additive is selected from the group consisting of $C_5$ to $C_{20}$ straight or branched chain alkanes and cycloalkanes, $C_5$ to $C_{20}$ straight or branched chain alkenes and cycloalkenes, $C_5$ to $C_{20}$ straight or branched chain alkynes and cycloalkynes.

4. The process of claim 3 wherein the amount of said additive is from about 1 pound per hundred cubic foot of natural gas to about 1 pound per 300 cubic foot of natural gas.

5. The process of claim 4 wherein the Btu capacity of said fuel is one thousand Btu per cubic foot.

6. A method of transporting natural gas which eliminates the need for ultra low temperature refrigeration units said method comprising, adding to natural gas at its source an organic additive which is normally liquid at ambient conditions and is selected from the group consisting of $C_5$ to $C_{20}$ hydrocarbons, alcohols and esters, and mixtures thereof, which when combusted yield only carbon and hydrogen containing products to provide a mixture which liquefies at substantially higher temperatures than natural gas alone, the amount of said additive being from about 0.1% by volume of said gas up to and including a vapor saturation amount at the existing conditions of temperature and pressure of said natural gas; and liquefying all of said mixture for fuel transport at temperatures substantially above minus 270° F. and transporting said liquefied mixture to its destination for end usage.

7. The method of claim 1 wherein said mixture can be liquefied, at atmospheric pressure, at temperatures substantially higher than minus 270° F. and up to as high as minus 50° F.

8. The method of claim 6 wherein said mixture can be liquefied, at atmospheric pressure, at temperatures substantially higher than minus 270° F. and up to as high as minus 50° F.

* * * * *